US006539190B2

(12) United States Patent
Oba et al.

(10) Patent No.: US 6,539,190 B2
(45) Date of Patent: Mar. 25, 2003

(54) PROCESS CARTRIDGE AND IMAGE FORMING APPARATUS COMPRISING CHARGING MEANS INCLUDING A CHARGE MEMBER AND ELECTROCONDUCTIVE PARTICLES

(75) Inventors: Hiroyuki Oba, Toride (JP); Junichi Kato, Kashiwa (JP); Yasushi Shimizu, Toride (JP); Hiroshi Satoh, Kitasomua-gun (JP); Masahiro Yoshida, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/795,475

(22) Filed: Mar. 1, 2001

(65) Prior Publication Data

US 2001/0028814 A1 Oct. 11, 2001

(30) Foreign Application Priority Data

Mar. 1, 2000 (JP) ..... 2000-055595

(51) Int. Cl.[7] ..... G03G 15/02; G03G 15/00

(52) U.S. Cl. ..... 399/174; 399/130; 399/150; 399/176

(58) Field of Search ..... 399/149, 174, 399/176, 130, 150

(56) References Cited

U.S. PATENT DOCUMENTS

| | | | | |
|---|---|---|---|---|
| 5,488,459 | A | 1/1996 | Tsuda et al. | 355/211 |
| 5,534,344 | A | 7/1996 | Kisu et al. | 428/323 |
| 5,543,899 | A | 8/1996 | Inami et al. | 355/219 |
| 5,565,961 | A | 10/1996 | Shoji et al. | 355/211 |
| 5,589,918 | A | 12/1996 | Oshida et al. | 399/114 |
| 5,602,623 | A | 2/1997 | Nishibata et al. | 399/111 |
| 5,682,574 | A | 10/1997 | Oshida et al. | 399/64 |
| 5,765,077 | A | 6/1998 | Sakurai et al. | 399/176 |
| 6,026,253 | A | 2/2000 | Domon et al. | 399/30 |
| 6,128,456 | A | 10/2000 | Chigono et al. | 399/176 |
| 6,128,462 | A | 10/2000 | Kato et al. | 399/350 |
| 6,134,407 | A | 10/2000 | Ishiyama et al. | 399/174 |
| 6,169,869 | B1 | 1/2001 | Inami et al. | 399/159 |
| 6,175,703 | B1 | 1/2001 | Nakazono et al. | 399/111 |

FOREIGN PATENT DOCUMENTS

| | | |
|---|---|---|
| JP | 62-264070 | * 11/1987 |
| JP | 10-307454 | 11/1998 |
| JP | 10-307455 | 11/1998 |

* cited by examiner

*Primary Examiner*—Joan Pendegrass
(74) *Attorney, Agent, or Firm*—Fitzpatrick, Cella, Harper & Scinto

(57) ABSTRACT

An image forming apparatus includes a movable image bearing member, a charger means including a charge member for electrically charging the image bearing member with electroconductive particles between the charge member and the image bearing member and a developing member for developing a latent image with toner mixed with electroconductive particles. The latent image is formed on the image bearing member having been charged by the charging means, and a toner image provided by development of the latent image by the developing member is transferred onto a recording material. The electroconductive particles mixed in the toner is carried by the image bearing member and are fed to between the charge member and the image bearing member. The width A, measured in a direction perpendicular to a moving direction of the image bearing member, in which the electroconductive particle are present between the charge member and the image bearing member, a width B in which the developing means is capable of effecting development, and a recording width C of a maximum size recording material, satisfy:

$$A>B\geqq C.$$

34 Claims, 7 Drawing Sheets

PROCESS CARTRIDGE AND IMAGE FORMING APPARATUS COMPRISING CHARGING MEANS INCLUDING A CHARGE MEMBER AND ELECTROCONDUCTIVE PARTICLES

FIELD OF THE INVENTION AND RELATED ART

The present invention relates to an image forming apparatus such as a copying machine or a printer and a process cartridge detachably mountable thereto, and more particularly to a device for electrically charging an image bearing member using charging-promotion particles.

Referring first to FIG. 6, there is shown an example of a conventional image forming apparatus. The image forming apparatus of these examples is a cleanerless-type copying machine or a printer using an image-transfer-type electrophotographic process and a reverse development type process.

Designated by reference numeral 1 is an image bearing member in the form of a drum-type electrophotographic photosensitive member (photosensitive drum), which is rotated in the clockwise direction indicated by an arrow at a predetermined peripheral speed (process speed).

Designated by 2 is a charging roller (charging member) of a contact-type charging means, and is a solid or sponge roller of elastic electroconductive material. It is press-contacted to the photosensitive drum 1 with a predetermined pressure. Designated by a is a charging contact portion where the charging roller 2 is press-contacted to the photosensitive drum 1 (charging portion).

The outer surface of the charging roller 2 is coated with charging-promotion particles m, and therefore, in the charging contact portion a, there are charging-promotion particles m. The charging roller 2 is rotated in the clockwise direction indicated by the arrow, and in the charging contact portion a, the peripheral movement of the surface of the charging roller 2 is opposite from the moving direction of the surface of the photosensitive drum 1, and therefore, the surface of the charging roller 2 and the surface of the photosensitive drum 1 are in sliding contact with each other with a peripheral speed difference with the charging-promotion particles m therebetween. The charging roller 2 is supplied with a predetermined charging bias voltage, DC-600V, for example, from a voltage source S1.

By doing so, the outer peripheral surface of the rotating photosensitive drum 1 is electrically charged uniformly to a potential substantially equal to be applied charging bias voltage applied to the charging roller 2, through a direct injection charging process.

Subsequently, the surface of the photosensitive drum 1 having been uniformly charged is exposed to image light L at an exposed portion b by unshown image exposure means, by which the potential (light potential) at the light portion of the surface of the photosensitive drum 1 attenuates to provide a potential contrast between the light portion potential and the dark portion potential (dark potential). That is, the electrostatic latent image is formed on the surface of the photosensitive drum 1, corresponding to the image exposure pattern.

Designated by 3 is a reverse-developing device using a developer T containing magnetic one component insulative toner (negative charged toner). Developer T is externally added with a predetermined amount of charging-promotion particles m. A thin layer of the developer T containing the charging-promotion particles m is formed on the surface of the rotatable developing sleeve 3*a* and is carried into a developing zone c where the developing sleeve 3*a* is closely opposed to the surface of the photosensitive drum 1.

The developing sleeve 3*a* is supplied with a predetermined developing bias voltage from a voltage source S2.

By doing so, the electrostatic latent image on the surface of the rotatable photosensitive drum 1 is developed with the negative charged toner (reverse development) at the developing zone c, by deposition of the toner on the light portion of the surface of the photosensitive drum 1. The charging-promotion particles m contained in the developer are supplied to and deposited on the surface of the photosensitive drum 1.

Designated by 4 is a transfer roller as transfer means. It is contacted to the surface of the photosensitive drum 1 with a predetermined pressure, and is rotated such that it codirectionally moves with the surface of the photosensitive drum substantially at the same peripheral speed. Designated by d is a transfer nip where the transfer roller 4 is press-contacted to the photosensitive drum 1. Into the transfer nip d, a transfer material P (recording material) is supplied at a predetermined timing from an unshown sheet feeder and is fed by the transfer nip d. The transfer roller 4 is supplied with a predetermined transfer bias voltage from a voltage source S3.

By doing so, the toner image is continuously transferred (electrostatic transfer) from the surface of the photosensitive drum 1 onto the surface of the transfer material P which is being fed by the transfer nip d The transfer material P having passed through the transfer nip d is separated from the surface of the rotating photosensitive drum 1 and is introduced into an unshown fixing device, where the transferred toner image is subjected to a fixing process The transfer material is discharged to the outside of the machine as a print or copy.

In this example, the image forming apparatus is a cleanerless type in which there is not provided a cleaner (cleaning device) exclusively for removing a small amount of residual toner remaining on the surface of the photosensitive drum 1. The untransferred toner, that is, the residual toner remaining on the surface of the photosensitive drum 1 after the image transfer operation, is carried again into the developing zone c by way of the charging contact portion a by the continuing rotation of the photosensitive drum 1, and is removed by the developing device 3 (simultaneous development and cleaning).

Since the charging-promotion particles m contained in the developer T in the developing device and deposited onto the surface of the photosensitive drum 1 during the developing operation, are electroconductive, and also since the charge polarity thereof is opposite from that of the developer (toner), they are substantially not transferred onto the transfer material P at the transfer portion d, and most of the charging-promotion particles m are kept deposited on the surface of the photosensitive drum 1. With the continuing rotation of the photosensitive drum 1, they are carried thereon to the charging contact portion a and are supplied thereto to provide always new injection sites. Therefore, even if the toner is accumulated on the charging roller 2, the deleterious result of improper charging can be avoided by supplying a large amount of the charging-promotion particles m.

A) Contact-type Charging Means Using the Charging-Promotion Particles m

A contact-type charging means using the charging-promotion particles m is disclosed in Japanese Laid-open Patent Application Hei 10-307454 and so on, and a structure with which the charging promotion particles are supplied to the contact portion between the charge member and the image bearing member from the developing means, is disclosed in Japanese Laid-open Patent Application Hei 10-307455 and so on. The contact-type charging means using the charging-promotion particles m is effective as a charging means for direct injection charging, uniformly to a predetermined voltage of a predetermined polarity, of the image bearing member (member to be charged) such as an electrophotographic photosensitive member, dielectric member for electrostatic recording or the like in electrophotographic image forming apparatuses or electrostatic recording image forming apparatuses.

The charging-promotion particles m are electroconductive fine particles for assisting the electric charging action, and it effects the direct injection charging by being present in the contact portion a between the charge member (charging roller 2) and the image bearing member (photosensitive drum 1). More particularly, the friction between the charging roller 2 and the photosensitive drum 1 at the charging contact portion a by the lubricating effect (friction reducing effect) of the charging-promotion particles m existing in the contact portion a so that the required rotation driving torque for the charging roller 2 is reduced. Therefore, the charging roller 2 and the photosensitive drum 1 can be contacted with a peripheral speed difference therebetween, and simultaneously, the charging roller 2 can be uniformly and closely contacted to the surface of the photosensitive drum 1 through the charging-promotion particles m. By this, the charging-promotion particles m rub the surface of the photosensitive drum 1 without a gap. Even if a simple member such as a charging roller, a charging sponge roller or the like is used, the ozoneless direct injection charging is made dominant with a low applied voltage.

Microscopically, the charging is uniform.

The direct injection charging fundamentally does not use the discharge phenomenon, but the electric charge is directly injected from the charging member into the image bearing member (member to be charged), by which the image bearing member is electrically charged, and therefore, the image bearing member can be electrically charged to the potential equivalent to the applied potential even if the voltage applied to the charging member is lower than the discharge starting voltage. Since no ion is produced due to the discharge phenomenon, and therefore, no damage due to the discharge product can be avoided.

B) Cleaner-less System (Toner Recycling System)

In an image forming apparatus of an image transfer type, the residual developer (toner) remaining on the surface of the image bearing member after the image transfer, is removed from the surface of the image bearing member by a cleaner and is collected as residual toner, which however is not its idea from the standpoint of protection of the environment. Therefore, the above-described cleanerless image forming apparatus has been proposed in which the residual toner remaining on the photosensitive drum 1 after the image transfer operation is removed from the photosensitive drum 1 by the developing device 3 (simultaneous development and cleaning), and the toner is collected into the developing device 3 and is reused.

In the simultaneous development and cleaning, the toner remaining on the image bearing member after the image transfer operation, is removed in the subsequent developing operation. That is, the image bearing member is continuously charged and exposed to the light to form an electrostatic latent image, and during the developing operation for the latent image, the residual toner is removed by the application of the fog-removing bias voltage (a fog removing potential difference Vback which is a potential difference between the DC voltage applied to the developing device and the surface potential of the image bearing member).

With this method, the residual toner is collected into the developing device and is reused in the subsequent image forming process, so that residual toner is eliminated, by which the maintenance operation is made easier. Additionally, since the cleaner is not used, the space required thereby can be saved, so that the image forming apparatus can be significantly downsized.

In the toner recycling system, the residual untransferred toner is not removed by a cleaner provided exclusively therefor, but is reused by collecting in the subsequent developing operation. Therefore, in the case that contact charging is employed as charging means for the image bearing member, it is a problem how to electrically charge the image bearing member while the toner, which is electrically insulating, exists in the charging contact portion where the contact charging member contacts the image bearing member. In the case of roller charging or the furbrush charging, the untransferred toner on the image bearing member is scattered into a non-pattern, and a high-voltage is applied to effect charging using electric discharge, in many cases. The magnetic brush charging is advantageous in that the magnetic brush portion of the electroconductive magnetic particles, which are the contact charging member, are contacted softly to the image bearing member, but the structure of the charging device is complicated, and defects resulting from the loss of the electroconductive magnetic particle constituting the magnetic brush, is significant.

In the case of the contact-type charging means using the charging-promotion particles m, the charging-promotion particles m are present in the charging contact portion a, so that even if the untransferred toner is mixed into the charging contact portion a or even if the charge member 2 is contaminated with the toner, the close contactness and the contact resistance between the charge member 2 and the image bearing member 1 can be maintained at the charging contact portion a. In addition, even if the toner is accumulated in the charging contact portion a or on the charge member 2, improper charging can be prevented by supplying a large amount of the charging-promotion particles m.

In this type of device, the untransferred toner T is subjected to charge injection similarly to the image bearing member 1 while the untransferred toner T passes between the image bearing member 1 and the charging-promotion particles m in the charging contact portion a during the charging process, by which the proper charging of the toner is maintained, and therefore, when the toner passes through the developing zone region, the toner is collected back into the developing device 3 with certainty. Accordingly, the electrophotographic process can be carried out without a cleaner.

In the above-described image forming apparatus in which the charging means for uniformly charging the image bearing member 1 to a predetermined polarity or potential, and the charging-promotion particles m are supplied from the developing means 3 to the charging contact portion a where the charge member 2 and then the image bearing member 1 contact each other, the width (measured in the longitudinal direction) in which the charging-promotion particles m are supplied is the same as the width in which the development is carried out, because the charging-promotion particles m to be supplied are mixed in the developer T in the developing container of the developing device 3 and because the charging-promotion particles m are supplied together with the developer when the latent image formed on the image bearing member 1 is being developed. In other words, even if the weakest of the charging roller 2 which is the charging member is made longer than the developing with, the injection charging does not occur at a longitudinal position (end portion) to which the charging-promotion particles m are not supplied, and therefore, the charging width is equal to the developing width.

When the charging width is equal to the developing width, the following problems arise. FIG. 7 shows an example of potentials of the photosensitive drum (image bearing member) 1 and the developing sleeve (developer carrying member) 3*a* adjacent an end of the development width, in which Vd is a dark potential (approx −600V), and V1 is a light potential (approx −150V). Designated by Vdc is a developing potential (approx −300V).

Point (2) corresponds to the end of the charging region, and the potential there is Vd, and the toner is not deposited on the point (2) because of the potential difference (back contrast) between points (1) and (2). However, at point (3), the potential is substantially 0 V, so that it is as if the charge has been attenuated by the exposure to light, and therefore, the toner is deposited to the point (3) due to the potential difference (contrast) between points (1) and (3) (so-called "lateral jump" of the toner) with the result of contamination of the background on the transfer material.

In order to avoid the lateral jump of the toner, it would be considered that charging-promotion particles m are applied to a range wider than the developing width before the start of the use of the apparatus. However, if the maximum width of the transfer material is larger than the developing width, the charging-promotion particles outside of the development width in the longitudinal direction are transferred onto the transfer material in long-term use, so that the amount of the charging-promotion particles gradually decreases with the results of improper charging and lateral jump of the toner.

SUMMARY OF THE INVENTION

Accordingly, it is a principal object of the present invention to provide an image forming apparatus and a process cartridge detachably mountable thereto, in which the reduction of the electroconductive particles is suppressed, and condemnation of the transfer material attributable to the lateral jump of the toner is prevented.

According to an aspect of the present invention, there is provided an image forming apparatus comprising a movable image bearing member; charging means including a charge member for electrically charging the image bearing member with electroconductive particles between the charge member and the image bearing member; and developing means for developing a latent image with toner mixed with electroconductive particles, wherein the latent image is formed on the image bearing member having been charged by the charging means, and a toner image provided by development of the latent image by the developing means is transferred onto a recording material, wherein the electroconductive particles mixed in the toner is carried by the image bearing member and is fed to between the charge member and the image bearing member, and wherein the width A, measured in a direction perpendicular to a moving direction of the image bearing member, in which the electroconductive particle are present between the charge member and the image bearing member, the width B in which the developing means is capable of effecting development, and the recording width C of a maximum size recording material, satisfy $A>B\geqq C$.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the attached drawings.

Figure 1:
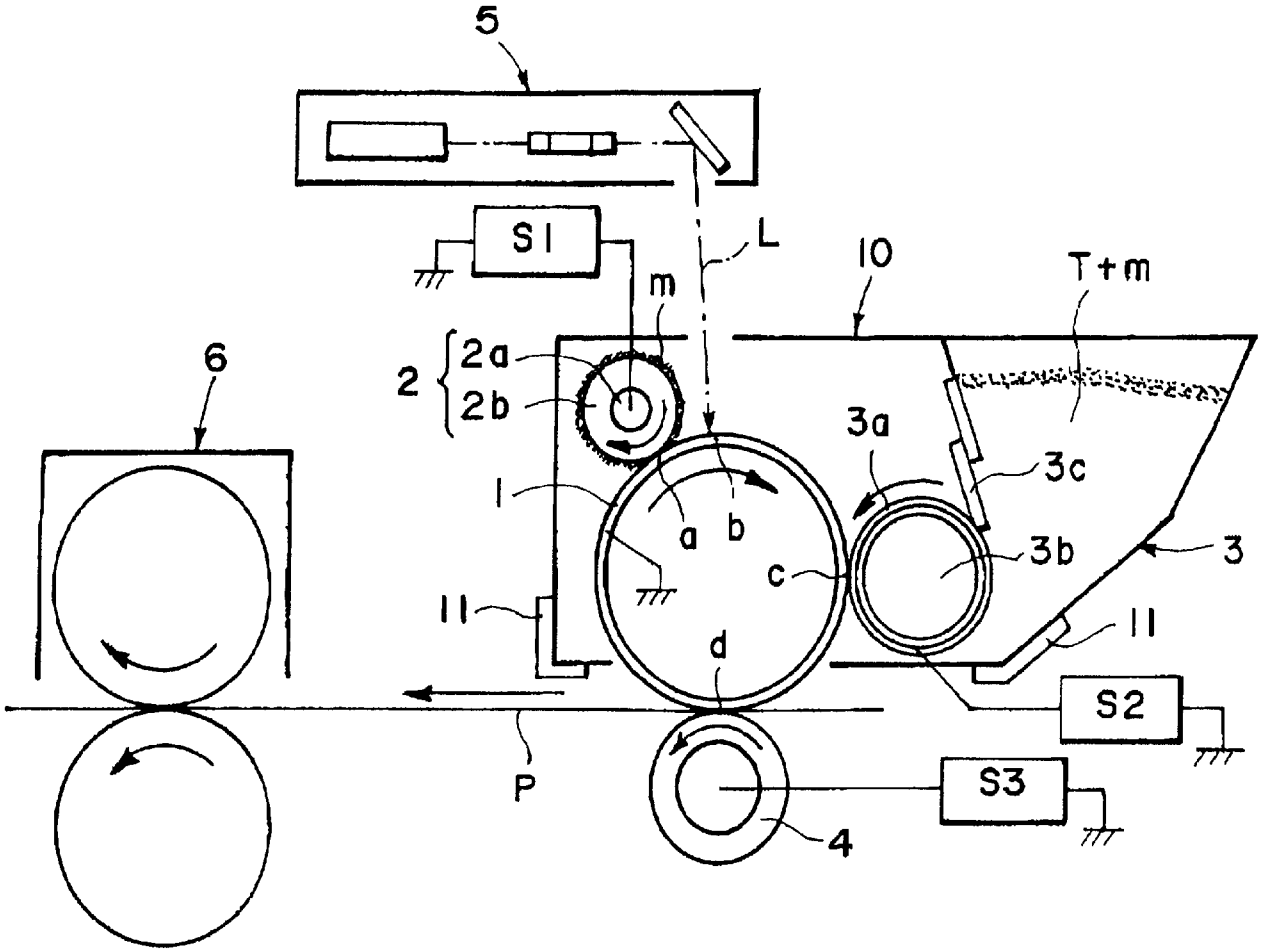
FIG. 1 illustrates an image forming apparatus according to an embodiment of the present invention.
Figure 2:
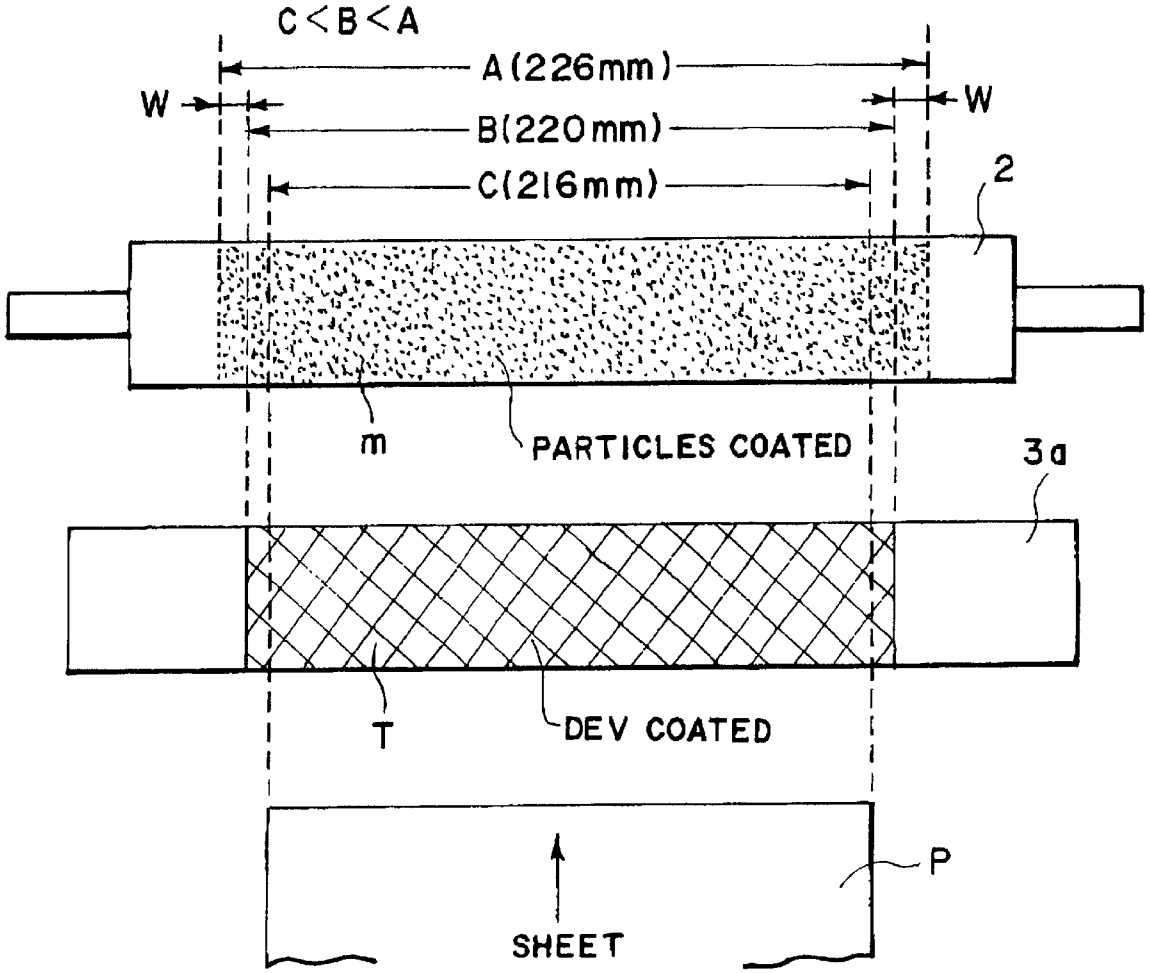
FIG. 2 shows the relationship among the charging width, the developing width and the maximum sheet passing width.
Figure 3:
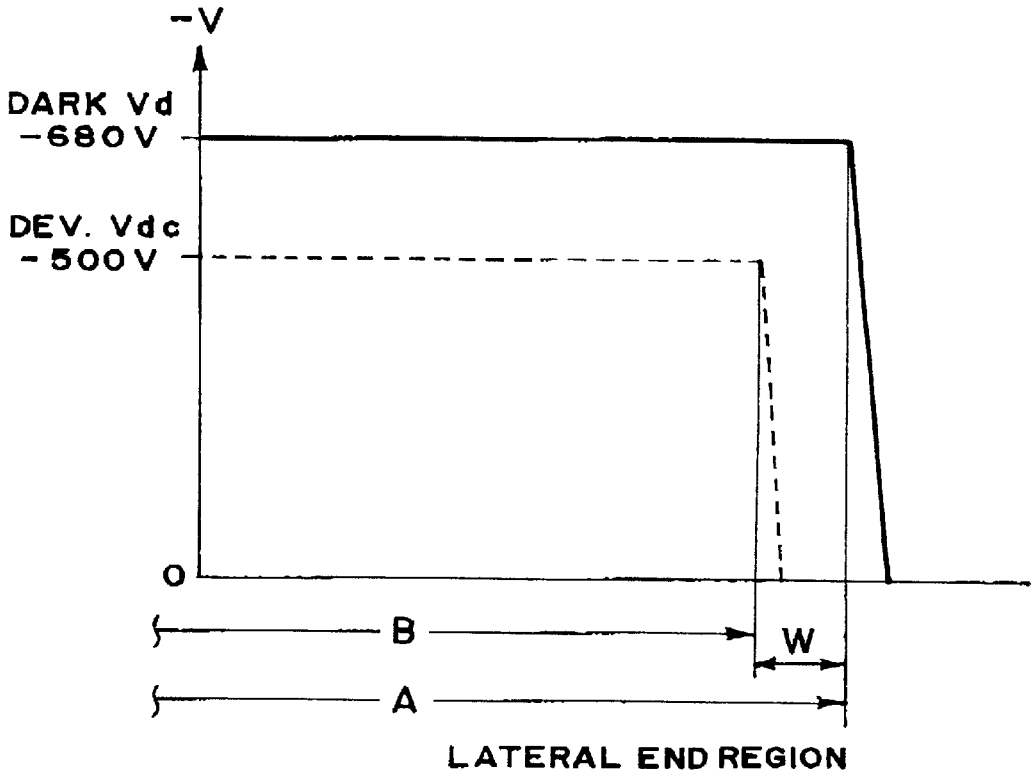
FIG. 3 shows the potentials of the photosensitive member and a developing device adjacent an end of the developing width.

Embodiment 1 (FIGS. 1–3)

FIG. 1 schematically shows an example of an image forming apparatus according to an embodiment of the present invention.

(1) General Arrangement of the Image Forming Apparatus

The image forming apparatus of this embodiment uses a transfer-type electrophotographic process using, a reverse development, a process cartridge and a cleanerless structure. It is a laser beam printer using contact-type charging means which uses charging-promotion particles as charging means for electrically charging an image bearing member in the form of a photosensitive drum, in which the charging-promotion particles are supplied to a charging contact portion from a developing device.

Figure 6:
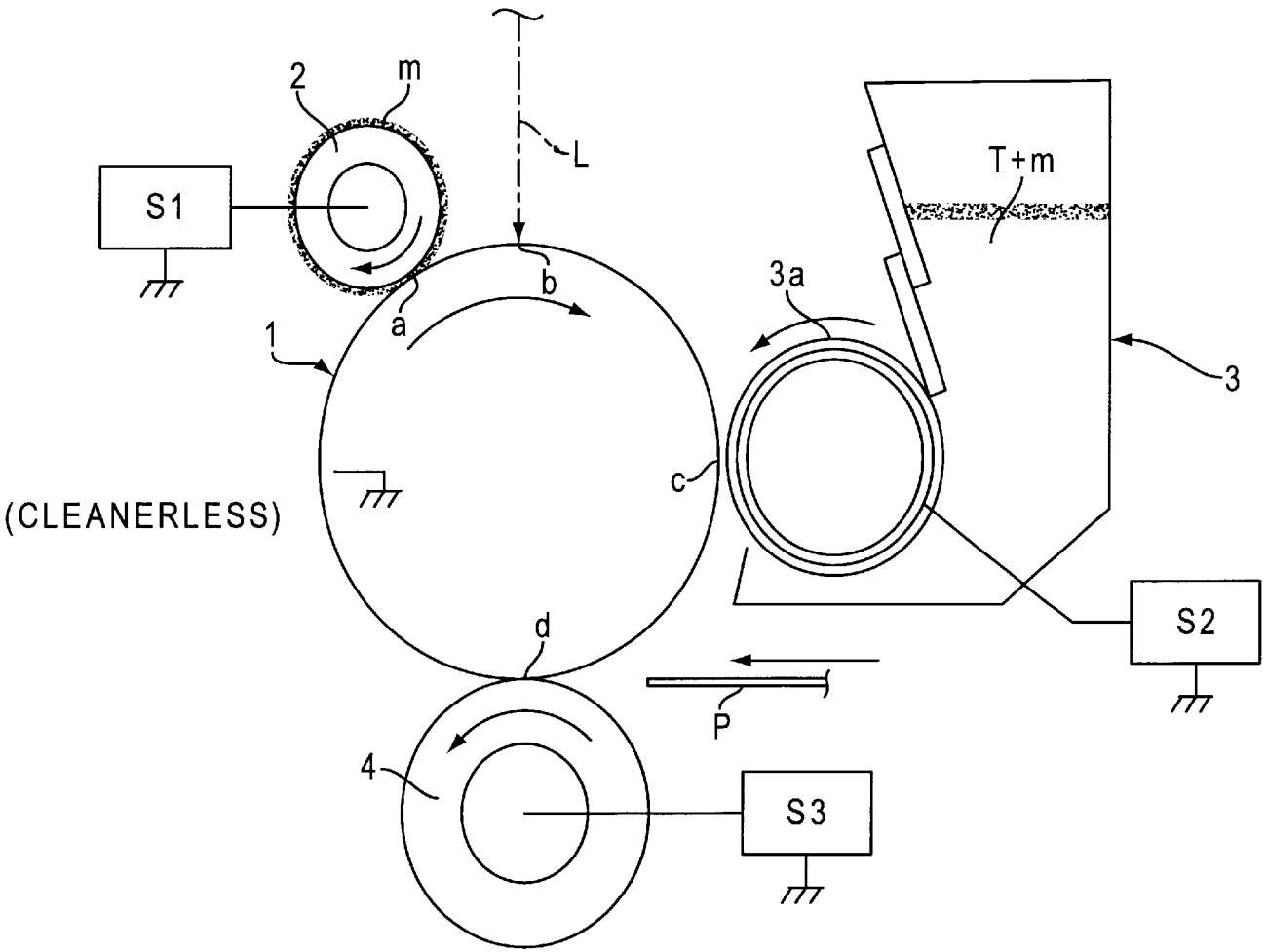
FIG. 6 (PRIOR ART)
FIG. 6 shows a conventional image forming apparatus.
Figure 7:
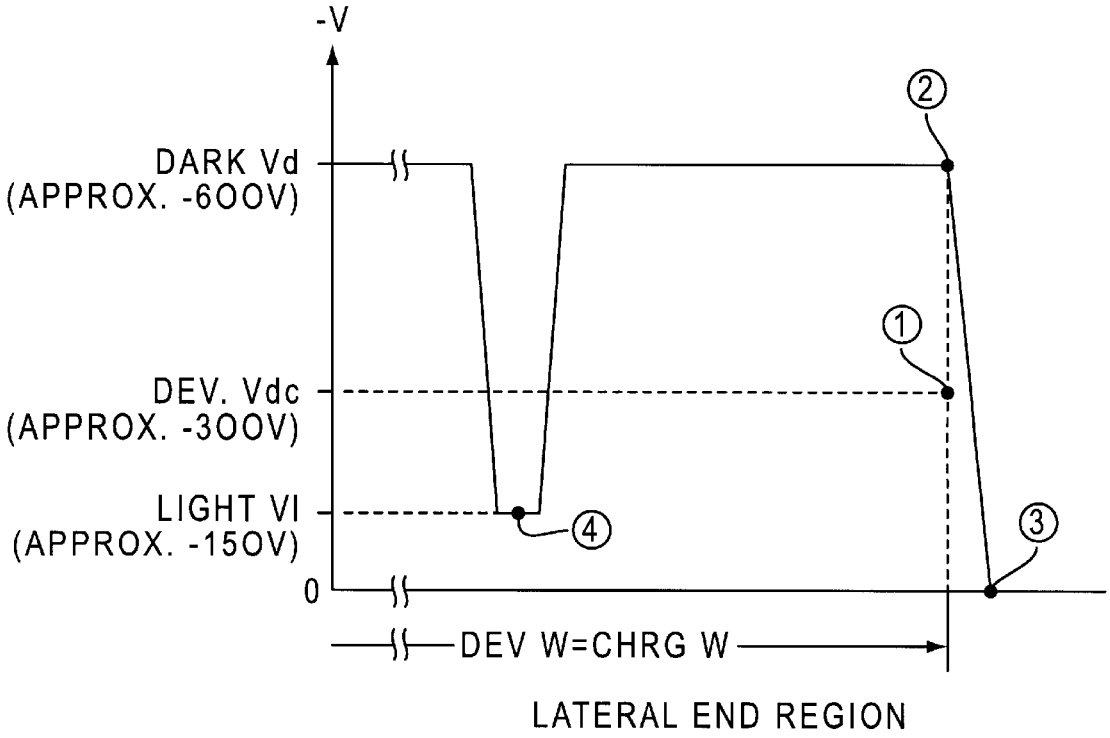
FIG. 7 (PRIOR ART)
FIG. 7 shows the potentials of the photosensitive member and a developing device adjacent an end of the developing width.

The same reference numerals used in FIG. 6 are assigned to the elements having the corresponding functions, and the detailed description thereof is omitted for simplicity.

In the printing of this embodiment, the image bearing member is an electrophotographic photosensitive drum 1 which is made of an OPC photosensitive member (negatively chargable photosensitive member) and which has a diameter of ϕ30 mm. It is rotated by unshown driving means in the clockwise direction indicated by an arrow at a peripheral speed of 50 mm/sec (process speed).

The contact charging member in the form of a charging roller 2 comprises a core metal 2*a* and an intermediate resistance layer 2*b* of rubber or foam member (flexible member) thereon. The intermediate resistance layer 2*b* comprises a resin material (urethane, for example), electroconductive particles (carbon black, for example), sulfurizing material, foaming material and so on, which is formed into a roller on the core metal 2*a*. The surface of the roller is abrasioned into a diameter of 12 mm and a length of 250 mm measured in the direction perpendicular to the moving direction. It is an electroconductive elastic roller. The roller resistance of the charging roller 2 according to this embodiment was measured as being $10^5$ Ω under the condition of a total pressure of 9.80665N (1 kgf) and an applied voltage of 100V.

Here, it is important that charging roller 2 functions as an electrode. In addition to the elasticity to keep sufficient contact with the photosensitive drum, it has a sufficiently low resistance to electrically charge the moving surface of the photosensitive drum 1. On the other hand, if the photosensitive drum 1 has a defective portion such as a pin hole, the voltage may leak through the hole. This should be prevented. In order to provide a sufficient charging property and an anti-leakage property, the resistance of the charging roller 2 is preferably in the range of $10^4$–$10^7$ Ω.

If the hardness of the charging roller 2 is too low, the shape thereof is not stabilized with a result of a poor contact property relative to the photosensitive drum 1, and if it is too high, it is difficult to assure the existence of the charging contact portion a between the photosensitive drum 1 and itself, and in addition, the microscopic contact property relative to the surface of the photosensitive drum is poor. In view of these, the Asker C hardness thereof is preferably 25° to 50°.

The material of the charging roller 2 is not limited to the elastic foam material, and other usable materials include EPDM, urethane, NBR, silicone rubber, IR or the like or foamed material thereof in which an electroconductive material such as carbon black and/or metal oxide is dispersed for resistance adjustment. The resistance adjustment may be effected using ion electroconductive material instead of dispersing the electroconductive material.

The outer peripheral surface of the charging roller 2 is coated with electroconductive particles (charging-promotion particles) beforehand. The charging roller 2 is press-contacted to the photosensitive drum 1 against the elasticity to provide a charging contact portion a. The charging contact portion a has a width of 3 mm. In this embodiment, the charging roller 2 is rotated in the clockwise direction indicated by an arrow at about 80 rpm such that the surface of the charging roller and the surface of the photosensitive member are moved at the same speed in the opposite directions at the charging contact portion a.

Thus, there is provided a speed difference between the surfaces of the charging roller 2 and the photosensitive member.

The core metal 2*a* of the charging roller 2 is supplied with a charging bias voltage of DC −700V from a charging bias applying voltage source S1. In this embodiment, there are charging-promotion particles m between the surfaces of the photosensitive drum 1 and the charging roller 2 at that charging contact portion a, so that the surface of the photosensitive drum 1 is uniformly charged to the voltage (−680V) which is substantially equal to the voltage applied to the charging roller 2 through direct injection charging process.

Designated by 5 is a laser beam scanner (exposure means) including a laser diode, a polygonal mirror and so on. The laser beam scanner produces a laser beam which is modulated in its intensity in accordance with an electric time series digital pixel indicative of image information, and the laser beam scans the surface of the rotating photosensitive drum 1, which has been uniformly charged. By the scanning exposure, an electrostatic latent image corresponding to the image information is formed on the surface of the rotating photosensitive drum 1.

The electrostatic latent image is developed into a toner image by a developing device 3. In this embodiment, a developing device 3 is a reverse-developing device using a developer T containing one component magnetic toner (negative charged toner). The developer T is externally added with a predetermined amount of charging-promotion particles m which are electroconductive particles.

Designated by 3*a* is a non-magnetic rotatable developing sleeve functioning as a developer carrying and feeding member and containing a magnet roller 3*b*. The rotatable developing sleeve 3*a* is provided, a regulating blade 3*c* is provided to form a thin layer of the developer T containing the charging-promotion particles m on the surface of the developing sleeve 3*a*. The regulating blade 3*c* functions to electrically charge the developer T not only to regulate the thickness of the layer of the developer. The developer applied on the rotatable developing sleeve 3*a* is carried to the developing zone (developing zone) c where the developing sleeve 3*a* is opposed to the photosensitive drum 1 by the rotation of the developing sleeve 3*a*. The developing sleeve 3*a* is supplied with a developing bias voltage by a developing bias applying voltage source S2. The developing bias voltage is in the form of a combination of DC voltage of −500V and rectangular AC voltage having a frequency of 1800 Hz and a peak-to-peak voltage of 1600V. By this, the electrostatic latent image, using the photosensitive drum 1, is developed with the toner (reverse development).

The developer T is produced through a mixing step of binder resin, magnetic particles and charge control material, a kneading step, a pulverization step and a classification step. Charging-promotion particles m and fluidizing material are externally added. The weight average particle size (D4) of the toner was 7 μm. The charging-promotion particle m was electroconductive zinc oxide particle having a particle size of 3 μm in this embodiment. In this embodiment, 2 parts by weight of the charging-promotion particles m were externally added to 100 parts by weight of the toner.

The electroconductivity charging-promotion particles m have a resistivity of $10^6$ Ω.cm and an average particle size of 3 μm including the secondary coagula (electroconductive zinc oxide particles) in this embodiment. Another material such as electroconductive inorganic particle such as another metal oxide, a mixture thereof with organic material and so on are usable.

In order to provide a uniform charging property, the particle size of the charging-promotion particles m is preferably not more than 50 μm, and further preferably, not more than 10 μm. The lower limit of the particle size is 10 nm from the standpoint of stable production thereof. The particle resistance is preferably not more than $10^{12}$ Ω.cm from the standpoint of the proper transfer of electric charge, and further preferably not more than $10^{10}$ Ω.cm. The charging-promotion particles m may be in the form of one next particles or in the form of secondary coagulated particles.

The transfer roller 4 is a roller having an intermediate resistance. A transfer material (recording material) P is supplied from an unshown sheet feeder to a transfer nip d at a predetermined controlled timing. The transfer roller 4 is supplied with a predetermined image transfer bias voltage from the transfer bias application voltage source S3, by which the toner image is sequentially transferred from the photosensitive drum 1 onto the surface of the transfer material P supplied to the transfer nip d. In this embodiment, the roller resistance value was 5×108 Ω, and the voltage of +2000V (DC voltage) was added for the image transfer. The transfer material P introduced to the transfer nip d is nipped and fed, while the toner image is transferred from the surface of the rotating photosensitive drum 1 onto the service of the transfer material by the electrostatic force and pressure.

Designated by 6 is a fixing device of a heat fixing type, for example. The transfer material P now having the transfer toner image is separated from the surface of the rotating photosensitive drum and then is introduced into the fixing device 6, where the toner image is fixed on the transfer material. The transfer material is discharged to the outside of the apparatus as a print or a copy.

In the print of this embodiment, the cleaner is not provided (cleanerless). The residual toner remaining on the surface of the rotating photosensitive drum after the image transfer is not removed by the cleaner, but is carried to the developing zone c by way of the charging contact portion a with the rotation of the photosensitive drum 1. In the developing device 3, the residual toner is collected into the developing device (simultaneous developing and cleaning) (toner recycling process).

In the printer of this example, a process cartridge 10 is constituted including the photosensitive drum 1, the charging roller 2 and the developing device 3 (three process means), and the process cartridge is detachably mountable to the main assembly of the printer. Designated by 11 are holding and guiding members provided in the main assembly to guide and support the process cartridge.

The process cartridge integrally contains an electrophotographic photosensitive drum, and charging means, developing means or cartridge, in the form of a unit or a cartridge, which is detachably mountable to a main assembly of an image forming apparatus. The process cartridge may contain the electrophotographic photosensitive drum, and at least one of charging means, developing means and cleaning means, in the form of a cartridge which is detachably mountable to the main assembly of the image forming apparatus. Furthermore, the process cartridge may contain at least the electrophotographic photosensitive drum and the developing means.

A proper amount of the charging-promotion particles m which are electroconductive and which are contained in the developer T in the developing device 3 as described hereinbefore, is transferred onto the photosensitive drum 1 together with the toner during a toner developing operation of the electrostatic latent image on the photosensitive drum 1 by the developing device 3. The toner image on the photosensitive drum 1 is attracted to the transfer material P by the transfer bias at the transfer nip d, but the charging promotion particles m on the photosensitive drum 1 do not positively transfer toward the transfer material P since the charging-promotion particles m are electroconductive, and therefore, they substantial remain on the photosensitive drum 1. By the existence of the charging-promotion particles m deposited on the surface of the photosensitive drum 1, the transfer efficiency of the toner image from the photosensitive drum 1 to the transfer material P is improved.

The image forming apparatus, which is a toner recycling process type, does not use a cleaner, and therefore, the untransferred toner and the remainder charging-promotion particles m remaining on the surface of the photosensitive drum 1 after the transfer, is carried to the charging contact portion a where the photosensitive drum 1 and the contact charging member contact each other with the rotation of the photosensitive drum 1, and they are deposited on the charging roller 2 and are mixed into the particles there. Therefore, the contact charging for the photosensitive drum 1 occurs with the charging-promotion particles m existing at the charging contact portion a between the photosensitive drum 1 and the charging roller 2. At the initial stage of the printing operation, the charging-promotion particles are not supplied to the surface of the charging roller, and therefore, it is desirable that charging-promotion particles m are applied on the surface of the charging roller beforehand.

Even if the toner is deposited or mixed with the particles due to the presence of such charging-promotion particles m (despite the contamination of the charging roller with the untransferred toner), the photosensitive drum 1 can be charged by the charging roller 2 through direct injection charging, since the charging roller 2 closely contacts the photosensitive drum 1 with the proper degree of the contact resistance, and the contact charging member is a simple roller. The charging roller 2 is closely contacted to the photosensitive member with the charging-promotion particles m therebetween, and the charging-promotion particles m existing at the contact portion between the charging roller 2 and the photosensitive drum 1 rub the surface of the photosensitive drum 1 without a gap, so that charging of the photosensitive drum 1 does not use a discharge phenomenon, and the safe and stabilized direct injection charging is dominant. The charging efficiency is improved, and the photosensitive drum 1 is charged to the potential which is the substrate equivalent to the voltage applied to the charging roller 2.

The untransferred toner particles mixed or deposited on the charging roller 2 are gradually ejected to the photosensitive drum 1 from the charging roller 2, and are carried to the developing zone c with the movement of the surface of the photosensitive drum 1. They are then collected by the simultaneous development and cleaning process in the developing device 3 (toner recycling process). As described hereinbefore, in the simultaneous development and cleaning, the toner having remained on the photosensitive drum 1 after the image transfer, is removed and collected by the fog removing potential difference Vback, during the next developing operation for the next image forming process. The fog removing potential difference is a potential difference between the DC voltage applied to the developing device and the surface potential of the photosensitive member. In the case of the reverse development as in this embodiment, the simultaneous development and cleaning operation is effected by an electric field effective to transfer the toner from the dark portion potential of the photosensitive member to the developing sleeve and an electric field effective to deposit the toner onto the light portion potential portion of the photosensitive member from the developing sleeve.

Even if the charging-promotion particles m fall from the charging roller 2, the charging property is maintained to be proper, since when the printer is operated, the charging-promotion particles m contained in the developer T of the developing device 3 are transferred onto the surface of the photosensitive drum 1 at the developing zone, and they are carried to the charging contact portion a by the rotation of the photosensitive drum 1 by way of the transfer nip d, so that charging-promotion particles m are supplied to the charging roller 2.

In this manner, in the contact charging type and transfer type image forming apparatus using a toner recycling process, the use is made of a charging roller as the contact charging member, and the low voltage ozoneless direct injection charging can be stabilized for a long term despite the contamination of the charging roller 2 with the untransferred toner, with uniform charging property. The problem or improper charging due to the ozone product can be avoided with simple and low cost structure in an image forming apparatus.

As described in the foregoing, the charging promotion particles m transfer to the photosensitive drum 1 together with the toner during the developing operation of the developing device 3, and the transferred charging-promotion particles m are hardly influenced by the transfer operation and are carried to the charging roller as they are, and then they are supplied to the charging roller. Therefore, only the charging-promotion particles m within the developer application width (measured in the direction perpendicular to the moving direction of the surface of the rotatable developing sleeve 3*a* (development width), are supplied to the charging roller. In the direct injection charging operation, the charging does not occur substantially in the position where there are no charging-promotion particles m. Therefore, the charging is equal to the development width.

The so-called lateral jump of toner at the initial stage of use of the toner, can be avoided by applying the charging-promotion particles m on the charging roller 2 in an area wider than the development width before the start of use of the apparatus. When the maximum width of transfer material (recording material) is larger than the development width, the charging-promotion particles m gradually departed from the charging roller 2 are carried over to the recording material in the transfer step at the portions outside the development width of the charging roller 2, although the amount is small. However, after the start of use of the apparatus, the amount of the charging-promotion particles m at the portion of the charging roller 2 monotoniously decreases with the result of gradual deterioration of the charging performance. Then, the lateral jump of toner may occur.

According to this embodiment of the present invention, the problem is solved by making the charging width A larger than the development width B with respect to the direction perpendicular to a moving direction of the surface of the photosensitive drum and by making the maximum width C of the transfer material P (the width of the recording material having the maximum size) substantially equal to or smaller than the development width B. By doing so, the deposition of the toner to the end marginal area of the image bearing member can be prevented.

In other words, in the printer of this embodiment, the charging width A, the development width B and the maximum sheet passing width C shown schematically on FIG. 2, satisfy C<B<A.

In the printer of this embodiment, the maximum sheet passing width C of the transfer material P is the longer side of a letter-size sheet (width=216 mm). The development width B is the width in which the developer T containing the charging-promotion particles m is applied on the developing sleeve 3*a*, and is 220 mm in this embodiment. As regards the charging width A, the investigations by the inventors have revealed that if w=(charging width A—development width B)/2 is not more than 2.0 mm, the toner is deposited to the uncharged portion at the end of the photosensitive drum 1, but if w is not less than 2.5 mm, the toner is not deposited to the uncharged portion at the end of the photosensitive drum 1. Therefore, the charging width A in this embodiment is 226 mm which is the width in which the charging-promotion particles m are applied to the charging roller 2 plus 3 mm at each of the left and right sides including a small margins.

FIG. 3 shows the potentials of the developing device 3 and the photosensitive drum 1 in the neighborhood of the end of the development width. In reverse development, the uncharged portion at the end of the photosensitive drum 1 is as if the charge has been attenuated by exposure. If the charging width A is made larger than the development width B, the toner does not laterally jump, and therefore, the toner deposition on the unnecessary portion at the end portion can be avoided. By making the maximum sheet passing width C of the transfer material P smaller than the development width B, the charging-promotion particle m outside the development width B on the charging roller 2 are not lost by the transfer material P. Therefore, the charging at the corresponding portion of the photosensitive drum 1 is stabilized without the occurrence of a lateral jump of the toner, thus avoiding the deposition of the toner onto the unnecessary part at the image end portion.

Embodiment 2

By reducing the width in which the developer is applied on the developing sleeve 3*a* (development width) B down to the maximum width C of the maximum, the apparatus can be downsized, and the cost can be reduced without causing a deterioration of its properties.

Figure 4:
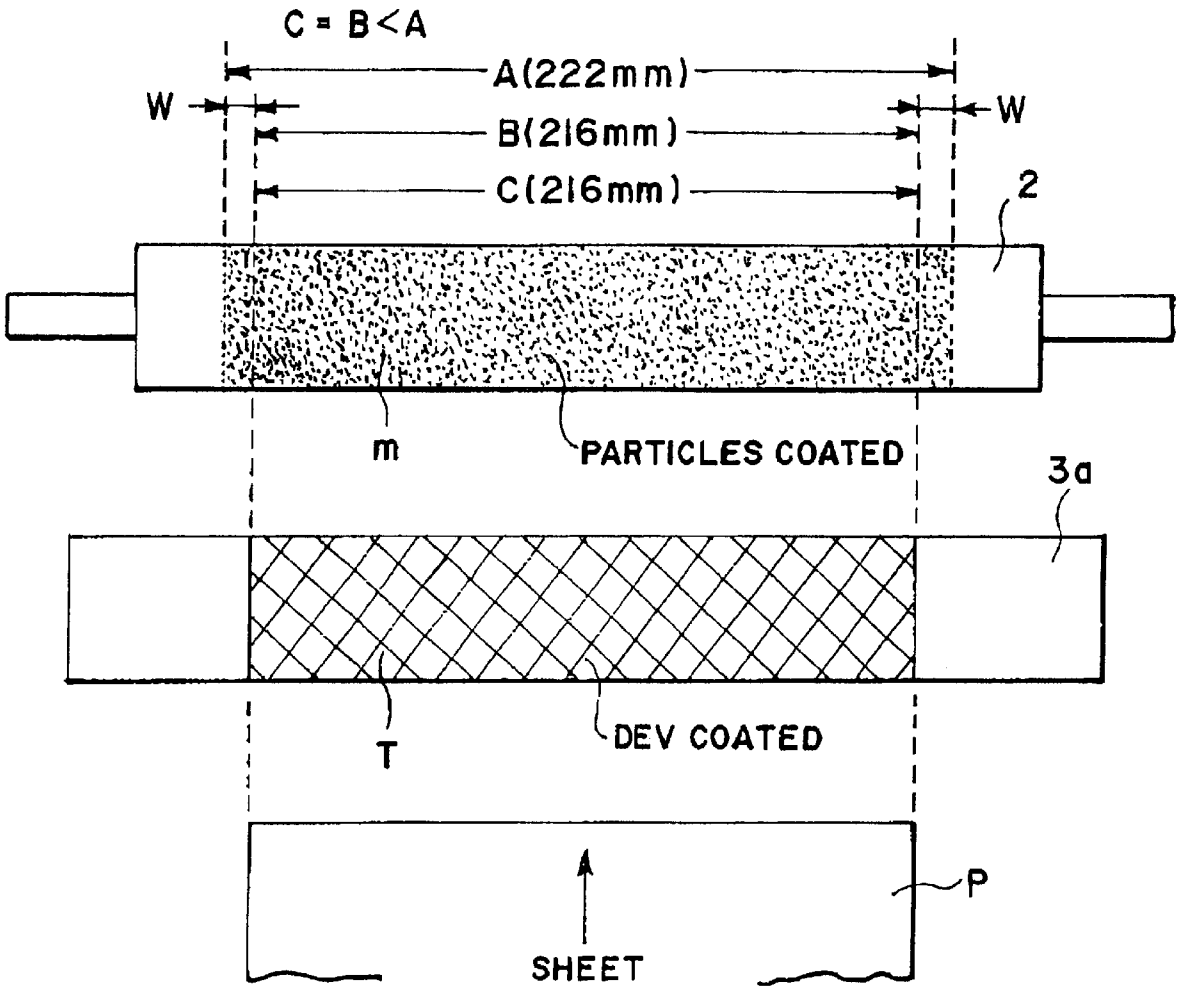
FIG. 4 shows the relationship among the charging width, the developing width and the maximum sheet passing width.

In the printer of this embodiment, the charging width A, the development width B and the maximum sheet passing width C satisfy C=B<A as shown in FIG. 4.

This embodiment is different from the first embodiment in that the development width B is 216 mm, which is the same as the maximum width C of the transfer material P, and correspondingly, the charging width A is 222 mm. The other structures are the same as with the first embodiment, and therefore, the detailed description is omitted for simplicity.

According to this embodiment, the maximum width CI of the transfer material P is equal to the development width B, and the apparatus can be downsized while the same advantageous effects as the first embodiment are provided. The downsizing of the apparatus leads to cost reduction.

Others

1) In order to provide stabilized and uniform direct injection charging, the image bearing member preferably has a surface layer having a volume resistivity of $10^9$–$10^{14}$ Ω.cm.

Figure 5:
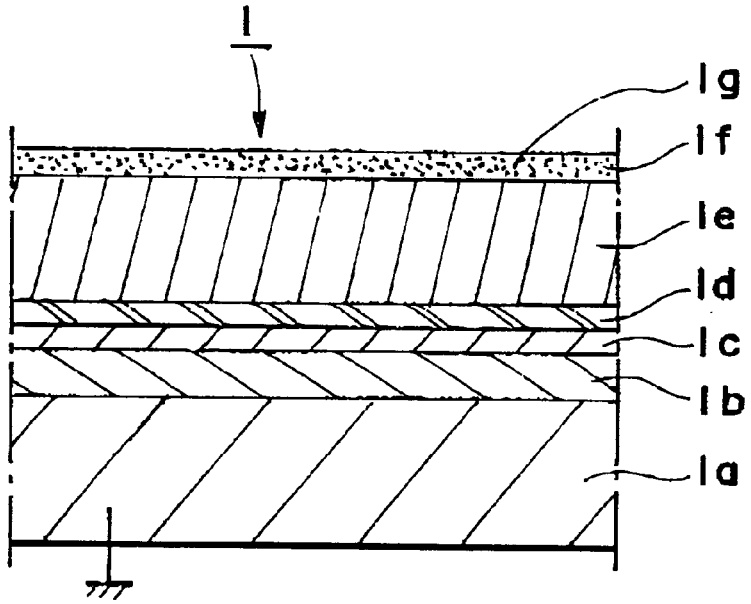
FIG. 5 illustrates a layer structure of the photosensitive member.

FIG. 5. The photosensitive member 1 comprises a usual organic photosensitive member including a main body of an aluminum drum 1*a*, a liner layer 1*b* thereon, a positive charge injection prevention layer 1*c* thereon, a charge generation layer 1*d* thereon and a charge transfer layer 1*e* thereon; and a charge injection layer 1*f* applied thereon.

The charge injection layer 1*f* comprises photo-curing type acrylic resin material (binder) in which ultra fine particles 1*g* of (diameter is 0.03 μm) $SnO_2$ as electroconductive particles (electroconductive filler), tetrafluoroethylene resin material (tradename of Teflon) as a lubricant and a polymerization initiator or the like are mixed and dispersed, and the material is applied and formed into a film by a photo-curing method.

The resistance and the surface energy of the surface layer of the charge injection layer 1*f* are of significance. In the charging type process using the direct injection of the charge, the charge can be transferred with high efficiency when the resistance of the photosensitive member is lowered. On the other hand, it is necessary to keep an electrostatic latent image for a predetermined period of time, and therefore, the volume resistivity of the charge injection layer if is preferably $1\times10^{9}\times10^{14}$ Ω.cm.

The charge injection layer 1*f* contains the lubricant so that surface energy of the photosensitive member is low. This causes the motion of the toner onto the transfer material, and the paper dust does not easily transfer onto the photosensitive member, the contamination of the contact charging member with the toner and/or the paper dust is suppressed, so that charging performance of the charging roller is maintained for a long period. In addition, the frictional force between the charging-promotion particle and the photosensitive member decreases, so that scraping of the photosensitive member is significantly suppressed.

Even if the charge injection layer 1*f* is not used, the equivalent effects are provided if the resistance range of the charge transfer layer 1*e* is within the above-described range. The equivalent effects can be provided in the case of an amorphous silicon photosensitive member having a surface layer with a volume resistivity of approximately $10^{13}$ Ω.cm.

2) The flexible contact charging member 2 may be in the form of a furbrush, felt or textile as well as a charging roller. By combining various materials, proper elasticity, electroconductivity, surface property and durable can be provided.

3) The charging bias applied to the charge member may contain an AC voltage component (AC component, a voltage having a periodically changing voltage). The AC voltage component may have a waveform which is sunisoidal wave, a rectangular wave, a triangular wave or the like. The AC component may be in the form of a rectangular wave formed by periodically activating and deactivating a DC voltage sources.

4) In the case of an image forming apparatus, the image exposure means as the information writing means for the charged photosensitive member (image bearing member) may be the above-described laser scanning means, digital exposure means such as a solid light emitting element array using an LED for example, and an analog image exposure means using halogen lamp, a fluorescent lamp or the like as the original document illumination light source. It will suffice if an electrostatic latent image corresponding to the image information can be formed.

5) The image bearing member may be a dielectric member for electrostatic recording. In such a case, the surface of the dielectric member is uniformly charged, and then the charged surface is selectively discharged by a discharging needle head, electron gun or another discharging means to form an intended electrostatic latent image.

6) The toner developing system for the electrostatic latent image may be of any type. It may be a regular developing system or a reverse development type.

Generally, the developing method of the electrostatic latent image is classified into the following:

1) Non-magnetic toner is applied on a developer carrying and feeding member such as a sleeve or the like by a blade or the like, and magnetic toner is applied on a developer carrying feeding member by magnetic force and is carried. The electrostatic latent image on the image bearing member is developed (one component non-contact development).

2) Toner is applied on the developer carrying and feeding member, and the electrostatic latent image on the image bearing member is developed in a contact state (one component contact development).

3) Toner particles and magnetic carrier particles are mixed (two component developer), and they are carried by magnetic force to a developing zone, and the electrostatic latent image on the image bearing member is developed in a contact state (two component contact development).

4) The two component developer is used, and the electrostatic latent image is developed in a non-contact state.

(7) The image forming apparatuses of the embodiments are of a cleanerless type, but the apparatus may be provided with a cleaning device exclusively for removing the untransferred toner from the surface of the image bearing member after the image transfer. In such a case, too, the charging-promotion particles supplied to the image bearing member from the developing device are fine, so that untransferred toner is trapped by the cleaning device, but the charging-promotion particles relatively easily pass under the cleaning blade of the cleaning device to reach the charging contact portion and to be supplied to the charge member.

(8) The transferring means is not limited to the transfer roller as in the foregoing embodiments, but may be in the form of a blade, belt or another contact type, or a non-contact transfer charging type using a corona charger.

(9) The present invention is applicable to an image forming apparatus for forming full-color images or multi-color images with superimposing transfer or the like using a transfer drum, a transfer belt or another intermediary transfer member, as well as to the monochromatic image formation apparatus.

As described in the foregoing, according to the embodiments of the present invention, the use is made of a contact-type charging means with charging-promotion particles as the charging means for uniformly charging the image bearing member to a predetermined polarity and potential, and the charging-promotion particles are supplied to the charging contact portion between the charge member and the image bearing member, wherein the maximum sheet processing width C<development width B<charging width A. By this, the decrease of the charging-promotion particles outside, on the charge member, of the development width B, so that charging at that portion can be stabilized. Since the charging-promotion particles can be supplied to the charging contact portion from the developing means only within the range of the development width of the developing means, the recording material does not pass outside the development width, so that charging-promotion particles are not lost at the end portions of the charge member by the sheet. By doing so, the lateral jump of the toner at the end portions attributable to the decrease of the charging width A, and the toner deposition to the unnecessary area resulting from the lateral jump of the toner can be prevented.

These and other objects, features and advantages of the present invention will become more apparent upon a consideration of the following invention taken in conjunction with the accompanying drawings.

What is claimed is:

1. An image forming apparatus comprising:

a movable image bearing member;

charging means including a charge member for forming a nip with a surface of said image bearing member and electroconductive particles which are provided in the nip over width A, measured in a direction perpendicular to a moving direction of the surface of said image bearing member, already at the start of use of said apparatus, said charging means being effective to electrically charge said image bearing member at the nip;

latent image bearing means for forming an electrostatic latent image on the surface of said image bearing member charged by said charging means; and developing means for developing a latent image formed on said image bearing member with developer having toner, wherein said developer contains electroconductive particles to be supplied to said nip to maintain the presence of the electroconductive particles in the nip, and said developing means is capable of supplying the electroconductive particles to said image bearing member within a width B, measured in said direction, and wherein said widths and a width C of a maximum size recording material on which an image developed by said developing means is transferred, satisfy:

$$A>B\geqq C.$$

2. An apparatus according to claim 1, wherein said developing means is effective to remove the toner remaining on said image bearing member after image transfer.

3. An apparatus according to claim 1, wherein said charge member includes a charging roller.

4. An apparatus according to claim 1, wherein the resistance of said electroconductive particles is not more than $10^{12}$ Ω.cm.

5. An apparatus according to claim 1, wherein said electroconductive particles have particle sizes of not more than 50 μm.

6. An apparatus according to claim 1, wherein said image bearing member has a surface layer, and a volume resistivity of said surface layer is not less than $10^{9}$ and not more than $10^{14}$ Ω.cm.

7. An apparatus according to claim 1, wherein said image bearing member is a photosensitive drum.

8. An apparatus according to claim 1, wherein a charging polarity of said charge member is the same as that of the toner.

9. A process cartridge detachably mountable to an image forming apparatus, said process cartridge comprising:

a movable image bearing member;

charging means including a charge member for forming a nip with a surface of said image bearing member and electroconductive particles which are provided in the nip over a width A, measured in a direction perpendicular to a moving direction of the surface of said image bearing member, already at the start of use of said process cartridge, said charging means being effective to electrically charge said image bearing member at the nip;

developing means for developing a latent image formed on said image bearing member with developer having toner, wherein said developer contains electroconductive particles to be supplied to said nip to maintain the presence of the electroconductive particles in the nip, and said developing means is capable of supplying the electroconductive particles to said image bearing member within a width B, measured in said direction, and wherein said widths and a width C of a maximum size recording material on which an image developed by said developing means is transferred, satisfy:

$$A>B\geqq C.$$

10. A process cartridge according to claim 9, wherein said developing means is effective to remove the toner remaining on said image bearing member after image transfer.

11. A process cartridge according to claim 9, wherein said charge member includes a charging roller.

12. A process cartridge according to claim 9, wherein the resistance of said electroconductive particles is not more than $10^{12}$ Ω.cm.

13. A process cartridge according to claim 9, wherein said electroconductive particles have particle sizes of not more than 50 μm.

14. A process cartridge according to claim 9, wherein said image bearing member has a surface layer, and a volume resistivity of said surface layer is not less than $10^{9}$ Ω.cm and not more than $10^{14}$ Ω.cm.

15. A process cartridge according to claim 9, wherein said image bearing member is a photosensitive drum.

16. An apparatus according to claim 9, wherein a charging polarity of said charge member is the same as that of the toner.

17. A process cartridge detachably mountable to an image forming apparatus, comprising:

a movable image bearing member;

charging means, including a charge member for forming a nip with a surface of said image bearing member and electroconductive particles which are provided in the nip over a width A, measured in a direction perpendicular to a moving direction of the surface of said image bearing member, already at the start of use of said process cartridge, said charging means being effective to electrically charge said image bearing member at the nip;

developing means for developing a latent image formed on said image bearing member with developer having toner, wherein said developer contains electroconductive particles to be supplied to said nip to maintain the presence of the electroconductive particles in the nip, and said developing means is capable of supplying the electroconductive particles to said image bearing member with a width B, measured in said direction, and wherein said widths satisfy A>B.

18. A process cartridge according to claim 17, wherein said developing means is effective to remove the toner remaining on said image bearing member after image transfer.

19. A process cartridge according to claim 17, a peripheral speed of said charging member and a peripheral speed of said image bearing member are different.

20. A process cartridge according to claim 19, wherein said charge member includes a charging roller.

21. A process cartridge according to claim 17, wherein the resistance of said electroconductive particles is not more than $10^{12}$ Ω.cm.

22. A process cartridge according to claim 17, wherein said electroconductive particles have particle sizes of not more than 50 μm.

23. A process cartridge according to claim 17, wherein said image bearing member has a surface layer, and a volume resistivity of said surface layer is not less than $10^{9}$ Ω.cm and not more than $10^{14}$ Ω.cm.

24. A process cartridge according to claim 17, wherein said image bearing member is a photosensitive drum.

25. An apparatus according to claim 17, wherein a charging polarity of said charge member is the same as that of the toner.

26. An image forming apparatus comprising:

a movable image bearing member;

charging means, including a charge member for forming a nip with a surface of said image bearing member and electroconductive particles which are provided in the nip over a width A, measured in a direction perpendicular to a moving direction of the surface of said image bearing member, already at the start of use of said apparatus, said charging means being effective to electrically charge said image bearing member at the nip;

latent image forming means for forming an electrostatic latent image on the surface of said image bearing member charged by said charging means;

developing means for developing a latent image formed on said image bearing member with developer having toner, wherein said developer contains electroconductive particles to be supplied to said nip to maintain the presence of the electroconductive particles in the nip, and said developing means is capable of supplying the electroconductive particles to said image bearing member within a width B, measured in said direction, and wherein said widths satisfy A>B.

27. An apparatus according to claim 26, wherein a charging polarity of said charge member is the same as that of the toner.

28. An apparatus according to claim 27, wherein said charge member includes a charging roller.

29. An apparatus according to claim 26, a peripheral speed of said charge member and a peripheral speed of said image bearing member are different.

30. An apparatus according to claim 26, wherein said developing means is effective to remove the toner remaining on said image bearing member after image transfer.

31. An apparatus according to claim 26, wherein the resistance of said electroconductive particles is not more than $10^{12}$ Ω.cm.

32. An apparatus according to claim 26, wherein said electroconductive particles have particle sizes of not more than 50 μm.

33. An apparatus according to claim 26, wherein said image bearing member has a surface layer, and a volume resistivity of said surface layer is not less than $10^{9}$ Ω.cm and not more than $10^{14}$ Ω.cm.

34. An apparatus according to claim 26, wherein said image bearing member is a photosensitive drum.

* * * * *

UNITED STATES PATENT AND TRADEMARK OFFICE

CERTIFICATE OF CORRECTION

PATENT NO. : 6,539,190 B2
DATED : March 25, 2003
INVENTOR(S) : Hiroyuki Oba et al.

It is certified that error appears in the above-identified patent and that said Letters Patent is hereby corrected as shown below:

Title page,
Item [75], Inventors, “Kitasomua-gun” should read -- Kitasouma-gun --.

Column 2,
Line 29, “nip d” should read -- nip d. --.
Line 34, “process” should read -- process. --.

Column 5,
Line 10, “with,” should read -- width, --.

Column 11,
Line 17, “(measured” should read -- measured --.

Column 13,
Line 5, “if” should read -- If --.

Column 15,
Line 45, “nip;” should read -- nip; and --.

Column 16,
Lines 13 and 60, “An apparatus” should read -- A process cartridge --.
Line 27, “nip;” should read -- nip; and --.
Line 42, “claim 17,” should read -- claim 17, wherein --.
Line 44, “charging” should read -- charge --.

Column 17,
Line 9, “means;” should read -- means; and --.

UNITED STATES PATENT AND TRADEMARK OFFICE

CERTIFICATE OF CORRECTION

PATENT NO. : 6,539,190 B2
DATED : March 25, 2003
INVENTOR(S) : Hiroyuki Oba et al.

It is certified that error appears in the above-identified patent and that said Letters Patent is hereby corrected as shown below:

Column 18,
Line 3, "claim 26," should read -- claim 26, wherein --.

Signed and Sealed this

Eighteenth Day of November, 2003

JAMES E. ROGAN
*Director of the United States Patent and Trademark Office*